US009980554B2

(12) United States Patent
Chen

(10) Patent No.: US 9,980,554 B2
(45) Date of Patent: May 29, 2018

(54) LOCKING STRUCTURE AND BRUSH HEAD THEREOF FOR REPLACEABLE TOOTHBRUSH

(71) Applicant: SUBAYU INDUSTRIAL CO., LTD., New Taipei (TW)

(72) Inventor: Shih-Hao Chen, New Taipei (TW)

(73) Assignee: SUBAYU INDUSTRIAL CO., LTD., New Taipei (TW)

( * ) Notice: Subject to any disclaimer, the term of this patent is extended or adjusted under 35 U.S.C. 154(b) by 220 days.

(21) Appl. No.: 15/007,931

(22) Filed: Jan. 27, 2016

(65) Prior Publication Data

US 2017/0208929 A1 Jul. 27, 2017

(51) Int. Cl.

| | |
|---|---|
| ***A46B 7/04*** | (2006.01) |
| ***A46B 9/04*** | (2006.01) |
| ***A46B 5/00*** | (2006.01) |

(52) U.S. Cl.

CPC ..... *A46B 5/0095* (2013.01); *A46B 7/042* (2013.01); *A46B 9/04* (2013.01); *A46B 2200/1066* (2013.01)

(58) Field of Classification Search

CPC ..... A46B 5/0095; A46B 9/04

See application file for complete search history.

(56) References Cited

U.S. PATENT DOCUMENTS

| | | | | |
|---|---|---|---|---|
| 5,224,234 A * | 7/1993 | Arsenault | A46B 5/0033 15/167.1 |
| 5,555,590 A * | 9/1996 | Blum | A46B 7/04 15/167.1 |
| 6,067,684 A * | 5/2000 | Kweon | A46B 7/04 15/167.1 |
| 6,138,316 A * | 10/2000 | Weihrauch | A46B 7/04 15/167.1 |

* cited by examiner

*Primary Examiner* — Randall Chin

(74) *Attorney, Agent, or Firm* — Chun-Ming Shih; HDLS IPR Services

(57) ABSTRACT

A locking structure for a replaceable toothbrush includes a locking plate and a brush head. An end portion of the locking plate includes elastic locking hooks, and the elastic locking hooks are arranged on the supporting platform. The brush head is replaceably installed on the supporting platform, and the brush head includes a brush head base and brush bristles. The brush head base includes a substrate and a surrounding plate extended from an edge of the substrate toward one side thereof, and the surrounding plate includes a locking slot for the elastic locking hook to lock thereon. The brush bristles are disposed on the substrate and extended away from the surrounding plate. Accordingly, the release of the locking and retrieval for disengagement of the brush head base are facilitated and the brush head base is firmly installed on the supporting platform.

11 Claims, 6 Drawing Sheets

LOCKING STRUCTURE AND BRUSH HEAD THEREOF FOR REPLACEABLE TOOTHBRUSH

BACKGROUND OF THE INVENTION

Field of the Invention

The present invention is related to a replaceable toothbrush, in particular, to a locking structure and a brush head thereof for a replaceable toothbrush.

Description of Related Art

For most of the toothbrushes currently available in the market, they are typically made of plastic materials, and their lifetimes are approximately three months. After the brush bristles on the toothbrush contact with the teeth for a period of time, it would cause a certain degree of wear out such that the performance of cleaning is reduced and is prone to the growth of bacteria; therefore, it must be discarded after a period of time, which causes not only the waste of resources but also the concerns of endangering the environmental protection.

To effectively improve the aforementioned problem, manufacturers in the industry then provides the design of toothbrushes with replaceable brush heads, which mainly comprises a handle portion and a brush head connected to the handle portion. The brush head comprises a base connected to the handle portion and a brush plate disposed with brush bristles thereon; wherein the base and the brush plate respectively include an engagement structure matching with each other to be inserted and attached onto each other in order to form a toothbrush with a replaceable brush head.

However, for the toothbrush with the replaceable brush head, the following problem is still found during the actual process of use. Since it uses the insertion method for the securement, the stability after the attachment is poor; as a result, after a period of time of use, the hole diameter tends to expand and becomes loose such that the condition of falling off is likely to occur.

SUMMARY OF THE INVENTION

An objective of the present invention is to provide a locking structure and a brush head thereof for a replaceable toothbrush, which is able to not only facilitate the release of the locking and retrieval for disengagement of the brush head base but also allow the brush head base to be firmly installed on the supporting platform.

To achieve the aforementioned objective, the present invention provides a locking structure for a replaceable toothbrush, the toothbrush having a supporting platform, the locking structure comprising a locking plate and a brush head. The locking plate includes an end portion having at least one elastic locking hook formed thereon, and the elastic locking hook is arranged on the supporting platform. The brush head is replaceably installed on the supporting platform, and the brush head comprises a brush head base and a plurality of brush bristles. The brush head base comprises a substrate and a surrounding plate extended from an edge of the substrate toward one side thereof, and a locking slot formed on the surrounding plate and provided for the elastic locking hook to lock thereon. The plurality of brush bristles are disposed on the substrate and extended toward a direction away from the surrounding plate.

To achieve the aforementioned objectives, the present invention provides a brush head for a replaceable toothbrush, comprising a brush head base and a plurality of brush bristles. The brush head base comprises a substrate and a surrounding plate extended from an edge of the substrate toward one side thereof, the surrounding plate having a locking slot formed thereon. The plurality of brush bristles are disposed on the substrate and extended toward a direction away from the surrounding plate.

The present invention has the following effects. The opening slot formed by the substrate and the surrounding plate circumference together is utilized in order to form a stable attachment configuration after the assembly onto the supporting platform. With the assistance of the oblique push surface acting on each one of the elastic locking hooks, the effect of effort saving can be achieved.

DETAILED DESCRIPTION OF THE INVENTION

The following provides a detailed description on the embodiments and technical content related to the present invention along with the accompanied drawings. However, it shall be understood that the accompanied drawings are provided for illustration purposes only and shall not be treated as limitations of the present invention.

Figure 1:
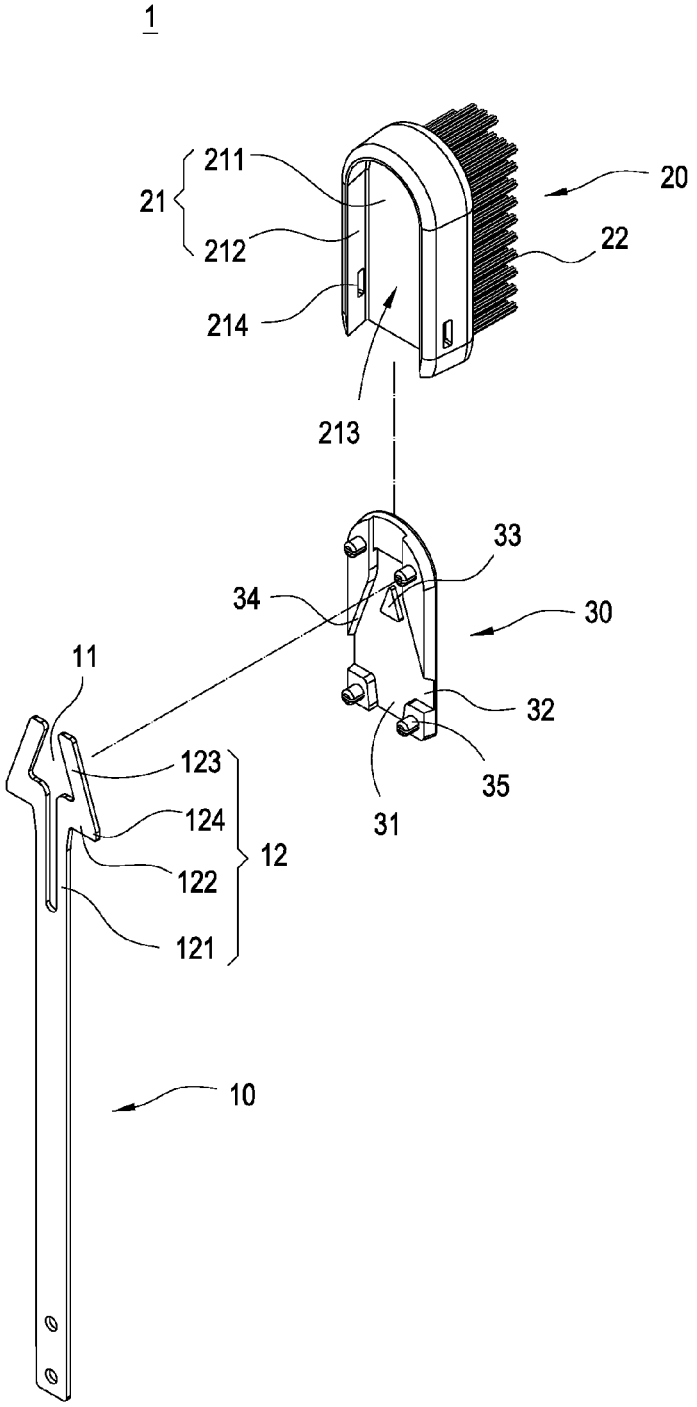
FIG. 1 is a perspective exploded view of a locking structure for a replaceable toothbrush of the present invention.

Please refer to FIG. 1. The present invention provides a locking structure for a replaceable toothbrush, and the locking structure 1 mainly comprises a locking plate 10 and a brush head 20.

The locking plate 10 is an elongated plate made of a metal material, such as a stainless steel. The center location of the front end of the locking plate 10 includes an arrow-shape opening slot 11 formed thereon. The two sides of the opening slot 11 includes an elastic locking hook 12 formed thereon respectively. Each one of the elastic locking hooks 12 comprises a longitudinal section 121, a lateral section 122 extended from a rear end of the longitudinal section 121 toward an outer side thereof and an oblique section 123 obliquely extended from the lateral section 122 toward an inner side thereof. Each one of the elastic locking hooks 12 is formed of a trapezoid shape with a narrower top and a wider bottom. In addition, the connecting area between the lateral section 122 and the oblique section 123 is formed of an angular hook 124.

The brush head 20 comprises a brush head base 21 and a plurality of brush bristles 22. The brush head base 21 is made of a plastic material, and it comprises a substrate 211 and a surrounding plate 212 extended from an edge of the substrate 211 toward one side thereof. The substrate 211 and the surrounding plate 212 circumference are together to form an opening slot 213. The lower side of the surrounding plate 212 includes a locking slot 214. The brush bristles 22 are disposed on the substrate 211 and extended toward a direction away from the surrounding plate 212.

The locking structure 1 of the present invention further comprises a base plate 30 received inside the aforementioned opening slot 213. One end surface of the base plate 30 includes a longitudinal through slot 31 and a lateral through slot 32 connected to the longitudinal through slot 31, and a triangular block 33 protrudes from a central section of the longitudinal through slot 31. In addition, an oblique push surface 34 is respectively formed along two sides of the triangular block 33 toward a location of the lateral through slot 32. Furthermore, four corners of the base plate 30 respectively include a securement column 35 protruded therefrom. Each one of the longitudinal sections 121 is received inside the longitudinal through slot 31, each one of the lateral sections 122 is received inside the lateral through slot 32, each one of the oblique sections 123 is formed between the triangular block 33 and each one of the oblique push surface 34, and each one of the angular hooks 124 is exposed to an external of the lateral through slot 32 in order to be locked onto the aforementioned locking slot 214 (as shown in FIG. 4).

Figure 2:
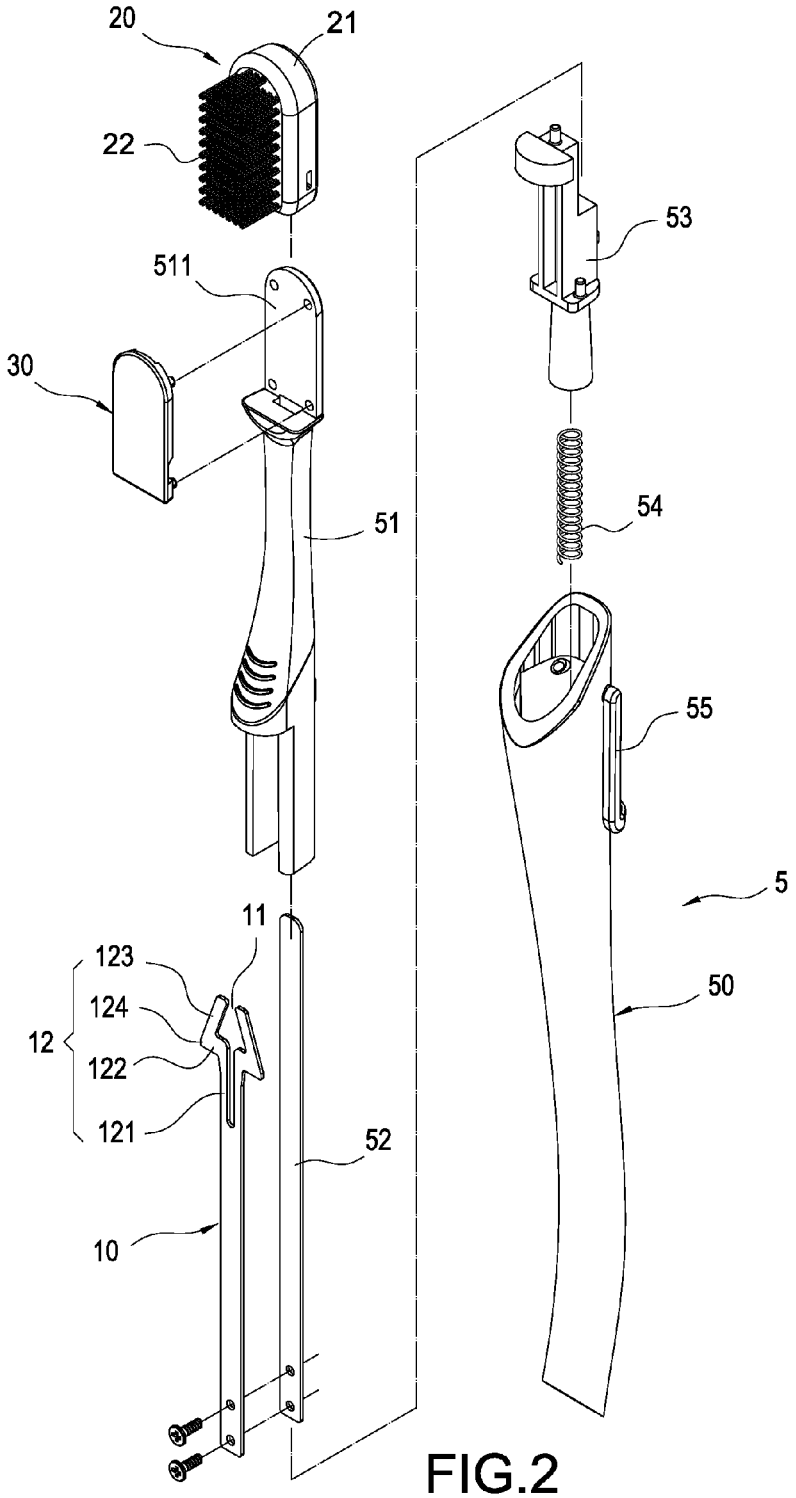
FIG. 2 is a perspective exploded view of the present invention applied to a replaceable toothbrush.
Figure 3:
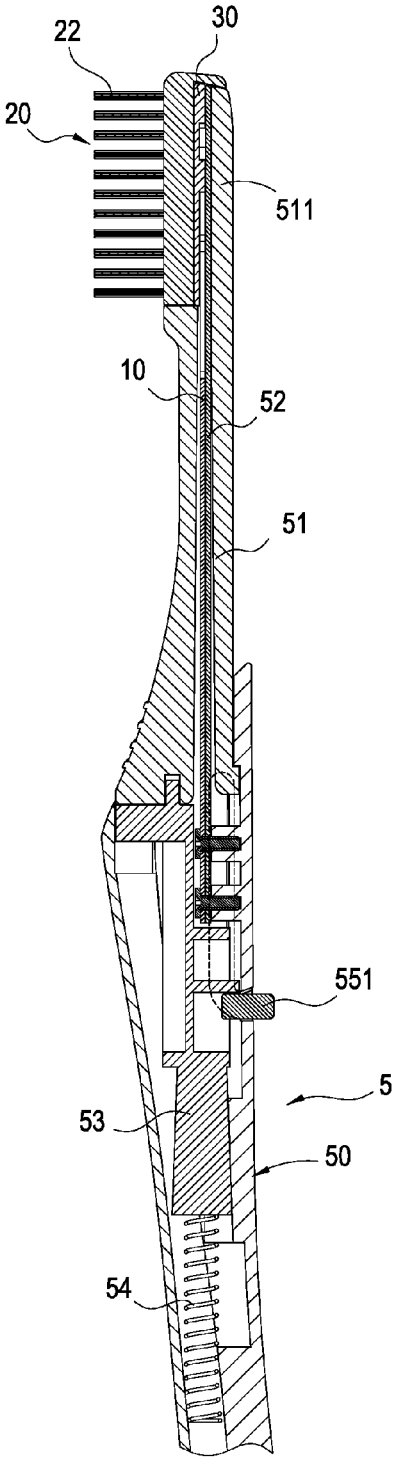
FIG. 3 is an assembly cross sectional view of the present invention applied to a replaceable toothbrush.
Figure 4:
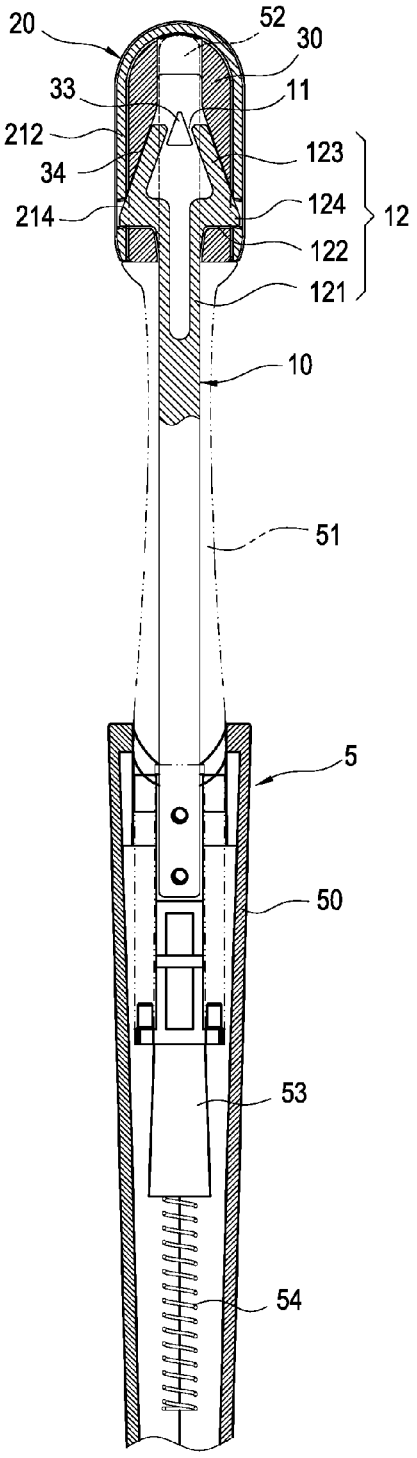
FIG. 4 is another assembly cross sectional view of the present invention applied to a replaceable toothbrush viewed from another angle.

Please refer to FIG. 2 to FIG. 4. The locking structure 1 of the present invention can be assembled onto a replaceable toothbrush 5. The replaceable toothbrush 5 comprises a handle portion 50, a handle front section 51, a push plate 52, a pressing member 53, a compression spring 54 and a rotating arm 55, wherein the locking plate 10 and the push plate 52 are stacked onto each other and penetrate into the internal of the handle front section 51. The handle front section 51 includes a supporting platform 511, the front ends of the aforementioned elastic locking hooks 12 and the push plate 52 are arranged on the supporting platform 511, the base plate 30 uses its securement columns 35 to insert into the supporting platform 511, and the front ends of the elastic locking hooks 12 and the push plate 52 are formed between the base plate 30 and the supporting platform 511. The pressing member 53 is connected to the compression spring 54 in series and is received at the internal of the handle portion 50, and the rear end of the handle front section 51 is inserted into the handle portion 50 and is fastened onto the rear ends of the locking plate 10 and the push plate 52 with screws in order to be fastened onto the handle portion 50. The rotating arm 55 is pivotally attached to the handle portion 50, and the rotating arm 55 includes a locking block 551.

Figure 5:
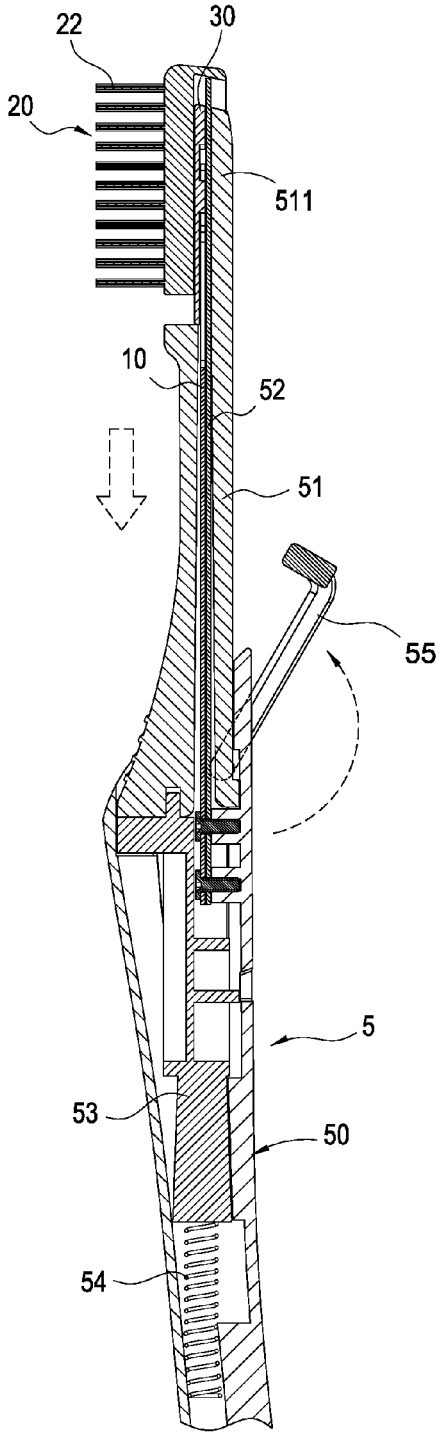
FIG. 5 is a cross sectional view showing a state of use of the present invention applied to a replaceable toothbrush.
Figure 6:
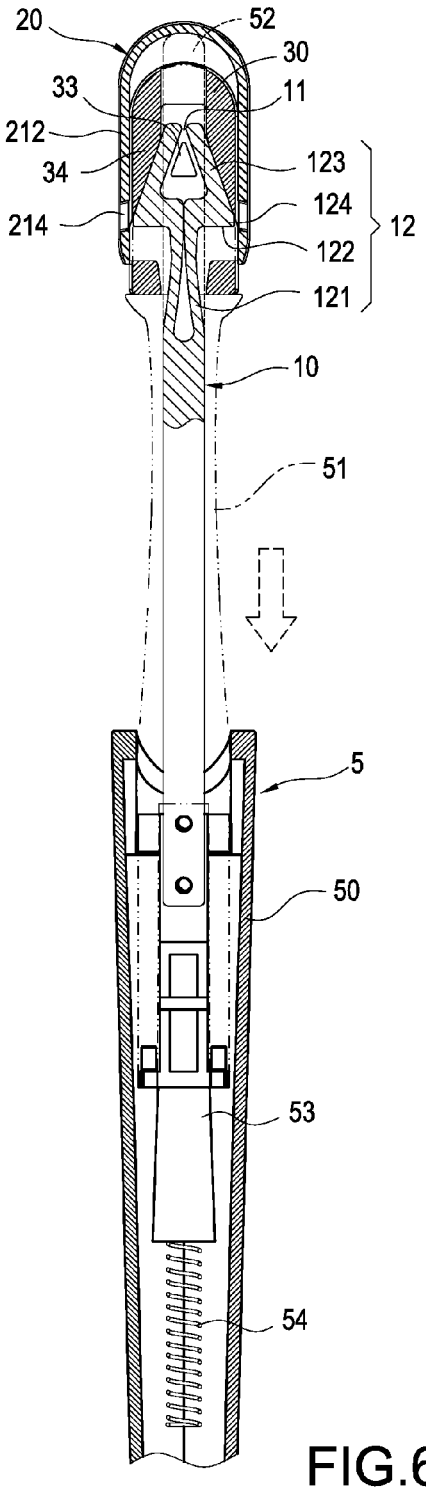
FIG. 6 is another cross sectional view showing a state of use of the present invention applied to a replaceable toothbrush.

Please refer to FIG. 5 and FIG. 6. During the use, the rotating arm 55 uses its pivotal attachment area as a rotational center to rotate upward in order to allow the locking block 551 to eject from the handle portion 50. Next, the handle front section 51 is pushed toward the direction of the internal of the receiving chamber of the handle portion 50, and at this time, the push plate 52 is stationary without movements while the supporting platform 511 moves downward and uses its oblique push surface 34 to push each elastic locking hook 12 to contract toward the inner side and to allow the angular hook 124 of each elastic locking hook 12 to move away from the locking slot 214 and the lateral through slot 32. Therefore, the locking securement between the brush head base 21 and the supporting platform 511 is released. In addition, as the top edge of the brush head base 21 is pushed by the push plate 52, it would also cause the brush head base 21 to eject and move toward the direction away from the supporting platform 511.

In view of the above, the locking structure and the brush head thereof for a replaceable toothbrush of the present invention is able to achieve the expected objectives of use while overcoming the drawbacks of the prior arts, which is of novelty and inventive step as well as complies with the requirement for the application of an invention patent. The present invention is, therefore, legitimately applied and seeks for the grant of the patent right for protection of the invention and the right of the inventor.

What is claimed is:

1. A locking structure for a replaceable toothbrush, the toothbrush having a supporting platform, the locking structure comprising:

a locking plate having an end portion with at least one elastic locking hook formed thereon, the elastic locking hook arranged on the supporting platform;

a brush head replaceably installed on the supporting platform, the brush head comprising:

a brush head base comprising a substrate and a surrounding plate extended from an edge of the substrate toward one side thereof, a locking slot formed on the surrounding plate and provided for the elastic locking hook to lock thereon; and a plurality of brush bristles disposed on the substrate and extended toward a direction away from the surrounding plate; and a base plate, the substrate and the surrounding plate circumference together to form an opening slot, wherein the base plate is secured onto the supporting platform and received inside the opening slot.

2. The locking structure for a replaceable toothbrush according to claim 1, wherein the end surface of the base plate includes a longitudinal through slot and a lateral through slot connected to the longitudinal slot, and a triangular block is formed to protrude outward from a central section of the longitudinal through slot, and an oblique push surface is respectively formed along two sides of the triangular block toward a location of the lateral through slot.

3. The locking structure for a replaceable toothbrush according to claim 2, wherein elastic locking hook comprises a longitudinal section, a lateral section extended from the longitudinal section toward an outer side and an oblique section obliquely extended from the lateral side toward an inner side; the longitudinal section is received inside the longitudinal through slot, the lateral section is received inside the lateral through slot, and the oblique section is formed between the triangular block and the oblique push surface.

4. The locking structure for a replaceable toothbrush according to claim 3, wherein a connecting area between the lateral section and the oblique section is formed of an angular hook, and the angular hook is exposed out to an external of the lateral through slot in order to lock onto the locking slot.

5. The locking structure for a replaceable toothbrush according to claim 4, wherein four corner areas of the base plate include a securement column protruded therefrom respectively, and the base plate uses each one of the securement columns to attach onto the supporting platform.

6. A locking structure for a replaceable toothbrush, the toothbrush having a supporting platform, the locking structure comprising:

a locking plate having an end portion with at least one elastic locking hook formed thereon, the elastic locking hook arranged on the supporting platform;

a brush head replaceably installed on the supporting platform, the brush head comprising:

a brush head base comprising a substrate and a surrounding plate extended from an edge of the substrate toward one side thereof, a locking slot formed on the surrounding plate and provided for the elastic locking hook to lock thereon; and a plurality of brush bristles disposed on the substrate and extended toward a direction away from the surrounding plate;

wherein a quantity of the elastic locking hook is two; an end portion of the locking plate includes an arrow-shape opening slot, and two sides of the opening slot are formed of the elastic locking hooks thereon respectively.

7. The locking structure for a replaceable toothbrush according to claim 6, further comprising a base plate, the substrate and the surrounding plate circumference together to form an opening slot, wherein the base plate is secured onto the supporting platform and received inside the opening slot.

8. The locking structure for a replaceable toothbrush according to claim 7, wherein the end surface of the base plate includes a longitudinal through slot and a lateral through slot connected to the longitudinal slot, and a triangular block is formed to protrude outward from a central section of the longitudinal through slot, and an oblique push surface is respectively formed along two sides of the triangular block toward a location of the lateral through slot.

9. The locking structure for a replaceable toothbrush according to claim 8, wherein elastic locking hook comprises a longitudinal section, a lateral section extended from the longitudinal section toward an outer side and an oblique section obliquely extended from the lateral side toward an inner side; the longitudinal section is received inside the longitudinal through slot, the lateral section is received inside the lateral through slot, and the oblique section is formed between the triangular block and the oblique push surface.

10. The locking structure for a replaceable toothbrush according to claim 9, wherein a connecting area between the lateral section and the oblique section is formed of an angular hook, and the angular hook is exposed out to an external of the lateral through slot in order to lock onto the locking slot.

11. The locking structure for a replaceable toothbrush according to claim 10, wherein four corner areas of the base plate include a securement column protruded therefrom respectively, and the base plate uses each one of the securement columns to attach onto the supporting platform.

* * * * *